US011536005B2

(12) United States Patent
Tsuda

(10) Patent No.: US 11,536,005 B2
(45) Date of Patent: Dec. 27, 2022

(54) SHOVEL

(71) Applicant: SUMITOMO CONSTRUCTION MACHINERY CO., LTD., Tokyo (JP)

(72) Inventor: Kazuya Tsuda, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 181 days.

(21) Appl. No.: 17/030,858

(22) Filed: Sep. 24, 2020

(65) Prior Publication Data

US 2021/0095440 A1 Apr. 1, 2021

(30) Foreign Application Priority Data

Sep. 26, 2019 (JP) ..... JP2019-176157

(51) Int. Cl.
*E02F 9/16* (2006.01)
*E02F 9/24* (2006.01)
*E02F 9/08* (2006.01)

(52) U.S. Cl.
CPC ..... *E02F 9/163* (2013.01); *E02F 9/0891* (2013.01); *E02F 9/24* (2013.01)

(58) Field of Classification Search
CPC .. B60R 21/131; E02F 9/08; E02F 9/14; E02F 9/163; E02F 9/24
USPC ..... 296/1.04, 190.03
See application file for complete search history.

(56) References Cited

U.S. PATENT DOCUMENTS 7,258,393 B2 * 8/2007 Lindqvist ..... E02F 9/166 296/190.03
7,665,801 B2 2/2010 Lee
8,287,033 B2 * 10/2012 Yamamoto ..... E02F 9/00 296/190.01
2011/0025096 A1 * 2/2011 Yamamoto ..... E02F 9/00 296/190.03

FOREIGN PATENT DOCUMENTS

| | | |
|---|---|---|
| EP | 2423393 | 2/2012 |
| EP | 3015606 | 5/2016 |
| JP | 2005-350948 | 12/2005 |
| JP | 2007-030866 | 2/2007 |
| JP | 2007-085017 | 4/2007 |
| JP | 2008-291541 | 12/2008 |
| JP | 2010-248846 | 11/2010 |
| JP | 2012-144254 | 8/2012 |

* cited by examiner

*Primary Examiner* — Jason S Daniels
(74) *Attorney, Agent, or Firm* — IPUSA, PLLC

(57) ABSTRACT

A shovel includes a lower traveling body, an upper turning body turnably mounted on the lower traveling body, an attachment attached to the upper turning body, a cabin mounted on the upper turning body, and a protection member configured to protect the cabin. The protection member is provided on the attachment or the upper turning body at a position corresponding to the front of the cabin.

8 Claims, 6 Drawing Sheets

SHOVEL

CROSS-REFERENCE TO RELATED APPLICATION

This application is based upon and claims priority to Japanese patent application No. 2019-176157, filed on Sep. 26, 2019, the entire contents of which are incorporated herein by reference.

BACKGROUND

Technical Field

The present invention relates to shovels.

Description of Related Art

A cabin serving as a cab is provided in a shovel, and an operator operates the shovel in the cabin. The cabin protects the operator from incoming flying objects and falling objects. Furthermore, the cabin is also required to protect the operator inside when the shovel tips over.

There is a shovel in which a protection part that supports the top of a cab from the side when the shovel tips over is provided behind the cab.

SUMMARY

According to an aspect of the present invention, a shovel includes a lower traveling body, an upper turning body turnably mounted on the lower traveling body, an attachment attached to the upper turning body, a cabin mounted on the upper turning body, and a protection member configured to protect the cabin. The protection member is provided on the attachment or the upper turning body at a position corresponding to the front of the cabin.

DETAILED DESCRIPTION

Figure 1:
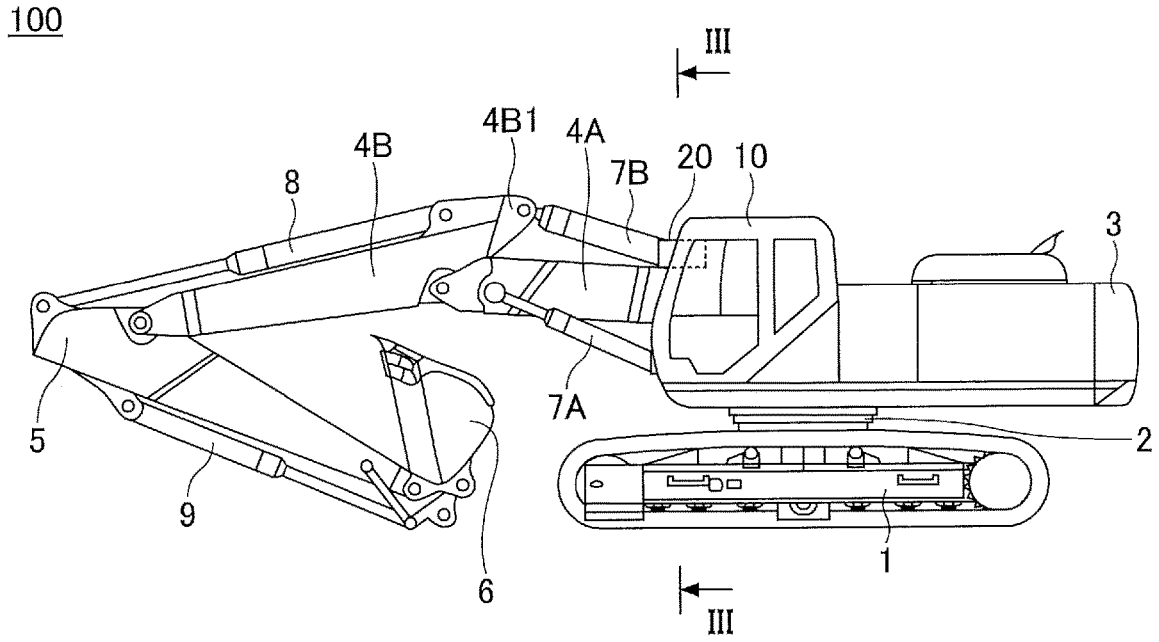
FIG. 1 is a side view of a shovel according to an embodiment.

There is a demand for more suitable protection of an operator in the cabin of a shovel.

According to an aspect of an embodiment, a shovel that controls the deformation of a cabin is provided.

An embodiment is described below with reference to the accompanying drawings. For easier understanding of the description, the same elements are referred to using the same reference numeral as much as possible in the drawings, and duplicate description thereof is omitted.

Figure 2:
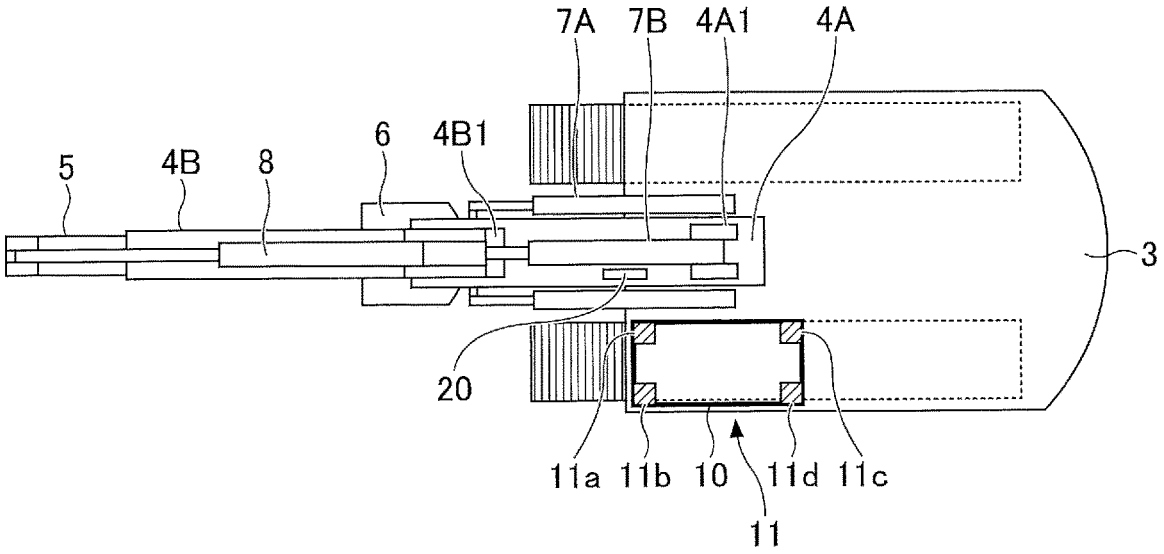
FIG. 2 is a plan view of the shovel according to the embodiment.

An overview of a shovel 100 according to an embodiment is given with reference to FIGS. 1 and 2. FIGS. 1 and 2 are a side view and a plan view, respectively, of the shovel 100 according to the embodiment.

The shovel 100 of this embodiment includes a lower traveling body 1; a turning mechanism 2; an upper turning body 3 turnably mounted on the lower traveling body 1 via the turning mechanism 2; a first boom 4A, a second boom 4B, an arm 5, and a bucket 6 that constitute an attachment (a work machine); and a cabin 10.

The lower traveling body 1 includes a pair of right and left crawlers that are hydraulically driven by respective travel hydraulic motors (not depicted) to cause the shovel 100 to travel. That is, the pair of travel hydraulic motors (an example of travel motors) drives the lower traveling body 1 (crawler) as a driven part.

The upper turning body 3 is driven by a turning hydraulic motor (not depicted) to turn relative to the lower traveling body 1. That is, the turning hydraulic motor is a turning drive part that drives the upper turning body 3 as a driven part, and can change the orientation of the upper turning body 3.

The upper turning body 3 may be electrically driven by an electric motor (hereinafter "turning electric motor") instead of being driven by the turning hydraulic motor. That is, the same as the turning hydraulic motor, the turning electric motor is a turning drive part that drives the upper turning body 3 as a driven part, and can change the orientation of the upper turning body 3.

The first boom 4A is pivotally attached to the front center of the upper turning body 3 in such a manner as to be able to move up and down. The second boom 4B is pivotally attached to the distal end of the first boom 4A in such a manner as to be able to pivot up and down. The arm 5 is pivotally attached to the distal end of the second boom 4B in such a manner as to be able to pivot up and down. The bucket 6 serving as an end attachment is pivotally attached to the distal end of the arm 5 in such a manner as to be able to pivot up and down. The first boom 4A, the second boom 4B, the arm 5, and the bucket 6 are hydraulically driven by first boom cylinders 7A, a second boom cylinder 7B, an arm cylinder 8, and a bucket cylinder 9 serving as hydraulic actuators, respectively.

The bucket 6 is an example of the end attachment. In place of the bucket 6, other end attachments such as a slope bucket, a dredger bucket, and a breaker may also be attached to the distal end of the arm 5 depending on work details, etc.

The cabin 10 is a cab in which the operator sits, and is mounted on the front left of the upper turning body 3. The cabin 10 includes a frame body 11 that forms a skeleton. The frame body 11 is famed of a combination of vertical frames, horizontal frames, and connecting frames. The vertical frames include a vertical frame 11*a* positioned at the front right, a vertical frame lib positioned at the front left, a vertical frame 11*c* positioned at the rear right, and a vertical frame 11*d* positioned at the rear left. The horizontal frames include a front horizontal frame lie (see FIG. 3) lying horizontally between the front-side right and left vertical frames 11*a* and 11*b* and a rear horizontal frame (not depicted) lying horizontally between the rear-side right and left vertical frames 11*c* and 11*d*. The connecting frames include a right connecting frame (not depicted) connecting the right-side front and rear vertical frames 11*a* and 11*c* and a left connecting frame (not depicted) connecting the left-side front and rear vertical frames 11*b* and 11*d*. Furthermore, to prevent vibration, the cabin 10 is elastically supported on a cabin support beam 13 (see FIG. 5) provided on a bottom frame 12 (see FIG. 5) of the upper turning body 3, via a damper 14 (see FIG. 5).

The shovel 100 of this embodiment illustrated in FIG. 1 has a two-piece boom including the first boom 4A and the second boom 4B as an attachment. As illustrated in FIGS. 1 and 2, the first boom cylinders 7A are provided as a pair, one on each side of the first boom 4A. The arrangement of the first boom cylinders 7A is not limited to this. For example, a single first boom cylinder may be provided below the first boom 4A. The second boom cylinder 7B is provided above the first boom 4A. The second boom cylinder 7B is, on its bottom side, rotatably attached to a bracket 4A1 provided on a top plate 4Aa of the first boom 4A on its proximal end side (the upper turning body 3 side). The second boom cylinder 7B is, on its rod side, rotatably attached to a bracket 4B1 provided on the second boom 4B at its proximal end.

A receiver 20 (a protection member) is provided on the top plate 4Aa of the first boom 4A. The receiver 20 is so placed as to overlap the front-side right vertical frame 11*a* as viewed from the side of the shovel 100 when at least the boom (first boom 4A) is at its lowermost position.

Figure 3:
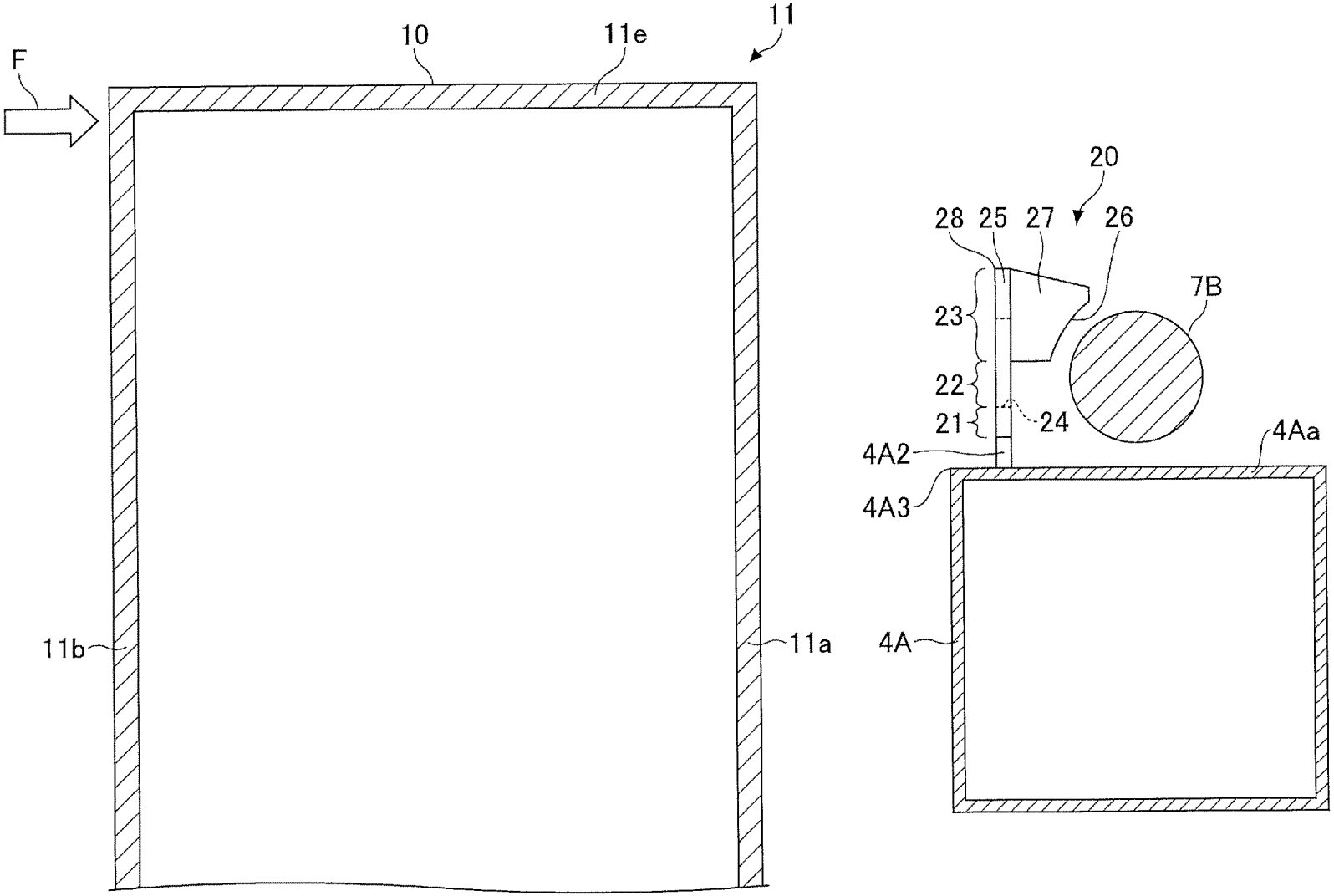
FIG. 3 is a sectional view of the shovel, taken along line of FIG. 1.
Figure 4:
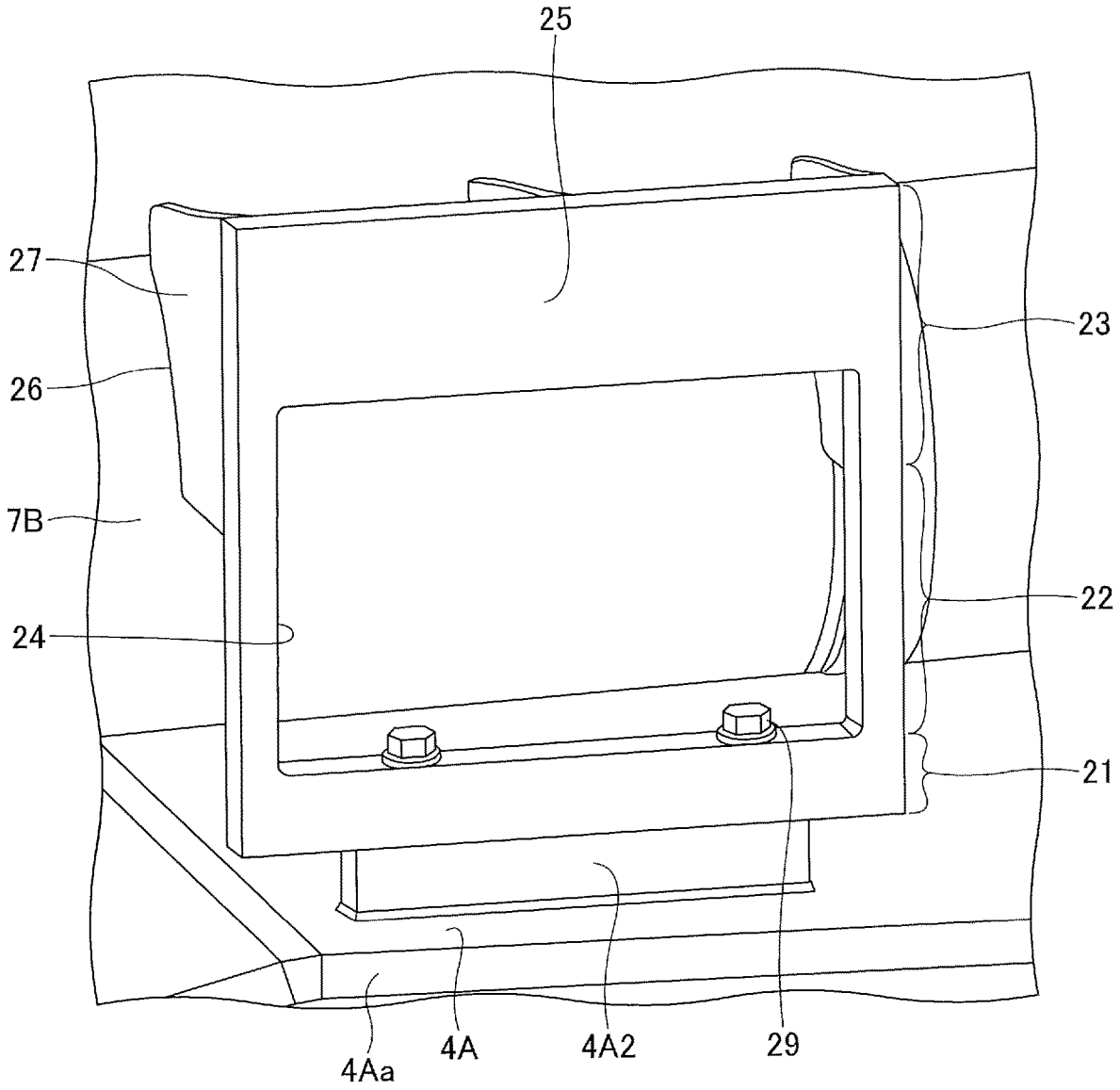
FIG. 4 is a perspective view of a receiver provided on the shovel according to the embodiment.

The receiver 20 is further described with reference to FIGS. 3 and 4. FIG. 3 is a sectional view of the shovel 100 of this embodiment, taken along line III-III of FIG. 1. FIG. 4 is a perspective view of the receiver 20 provided on the shovel 100 of this embodiment.

A seat 4A2 for attaching the receiver 20 is provided on the top plate 4Aa of the first boom 4A. For example, the seat 4A2 is fixed to the top plate 4Aa of the first boom 4A by welding. As illustrated in FIGS. 1 and 2, the receiver 20 is provided at a position corresponding to the front-side right vertical frame 11*a* of the cabin 10.

The receiver 20 includes a fixation part 21, a low stiffness part 22, and a high stiffness part 23. Furthermore, the receiver 20 includes a plate member 25 including an opening 24, and ribs 27 each including a circular arc part 26 and laterally (horizontally) extending from the plate member 25.

The fixation part 21 is a portion of the plate member 25 on its proximal end side (lower than the opening 24). For example, through holes (not depicted) for inserting bolts 29 are formed in the fixation part 21. Furthermore, tapped holes (not depicted) are formed in the seat 4A2. The receiver 20 is fixed (fastened) to the seat 4A2 with the bolts 29.

The low stiffness part 22 is a portion of the plate member 25 where the opening 24 is provided and the ribs 27 are not provided. The low stiffness part 22 is lower in stiffness than the high stiffness part 23. Furthermore, the low stiffness part 22 connects the fixation part 21 and the high stiffness part 23. The low stiffness part 22 deforms when the cabin 10 falls toward the first boom 4A to press the receiver 20 toward the first boom 4A. As illustrated in FIGS. 3 and 4, when the receiver 20 is not pressed by the cabin 10, the plate member 25 stands by itself without falling toward the second boom cylinder 7B. Thus, the high stiffness part 23 is so positioned as not to contact the second boom cylinder 7B when the receiver 20 is not pressed by the cabin 10.

The high stiffness part 23 is a distal end portion of the plate member 25 higher in stiffness than the low stiffness part 22. The high stiffness part 23 includes the ribs 27 (three in FIG. 4). The ribs 27 are fixed to a surface of the plate member 25 facing the second boom cylinder 7B by, for example, welding. On each rib 27, the corresponding circular arc part 26, which contacts the second boom cylinder 7B along its shape when the receiver 20 is pressed toward the first boom 4A by the cabin 10, is formed.

A function of the receiver 20 is described below.

When the attachment is operated during the normal operation of the shovel 100, the second boom cylinder 7B pivots up and down on the bracket 4A1 provided on the top plate 4Aa of the first boom 4A serving as a support point. As illustrated in FIG. 3, when the receiver 20 is not pressed by the cabin 10, the second boom cylinder 7B is pivotable without contacting the receiver 20.

For example, when the shovel 100 tips over counterclockwise to the side, the cabin 10 contacts the ground to receive a lateral force F on the upper part of the left side of the cabin 10 (see FIG. 3). In the case of receiving the lateral force F on the left side of the cabin 10, the cabin 10, which is elastically supported relative to the upper turning body 3, inclines toward the first boom 4A (rightward in FIG. 3), so that the front-side right vertical frame 11*a* of the cabin 10 contacts a contact part 28 of the receiver 20 (the top of the plate member 25). The receiver 20 is pressed toward the first boom 4A by the cabin 10, so that the low stiffness part 22 deforms until the circular arc parts 26 of the high stiffness part 23 contact the second boom cylinder 7B. After the circular arc parts 26 of the high stiffness part 23 contact the second boom cylinder 7B, the low stiffness part 22 stops deforming. As a result, the cabin 10 contacts the receiver 20 at the contact part 28 to be supported by the high stiffness part 23 and the second boom cylinder 7B.

Without the receiver 20, the cabin 10 would tip over to contact a contact part 4A3 of the top plate 4Aa of the first boom 4A because of the lateral force F. At the time of deformation, the cabin 10 (the vertical frame 11*a*) would start to deform at a point contacting the contact part 4A3 because of the lateral force F.

In contract, according to the shovel 100 of this embodiment, when the cabin 10 deforms, the cabin 10 (the vertical frame 11*a*) starts to deform at a point contacting the contact part 28 of the receiver 20 because of the lateral force F. According to the shovel 100 of this embodiment, the start point of defamation can be higher. Therefore, it is possible to control the deformation of the cabin 10. That is, as described above, the lateral force F acts on the upper part of the left side of the cabin 10. The top of the cabin 10 has high stiffness. Therefore, the front-side right vertical frame 11*a* of the cabin 10 starts to deform at a point contacting the contact part 28 of the receiver 20 in such a manner as to bend on its upper side. A higher start point of defamation makes it possible to ensure a wider space in the cabin 10 below the start point. Furthermore, a higher start point of deformation causes the start point to be closer to the point of effort of the lateral force F. This makes it possible to reduce a bending moment to control the deformation of the vertical frame 11*a*.

Figure 5:
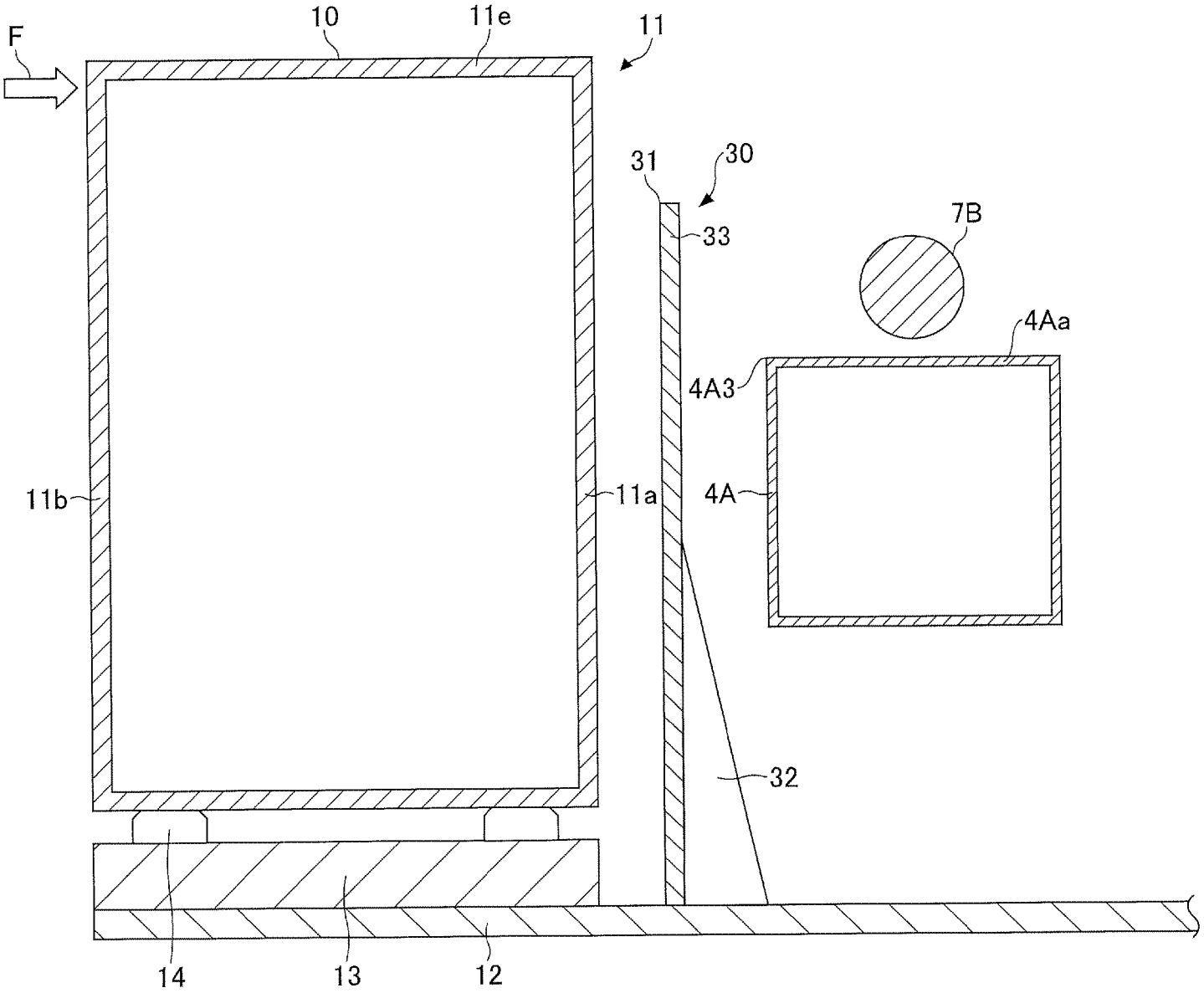
FIG. 5 is a sectional view of the shovel, illustrating another example configuration of the shovel.

An overview of another example configuration of the shovel 100 according to this embodiment is given with reference to FIG. 5. The sectional view of FIG. 5 corresponds to the sectional view of FIG. 3. The shovel 100 of FIG. 5 is different in that a receiver 30 (a protection member) is provided in place of the receiver 20 (see FIG. 3) from, but may be otherwise equal to, the shovel 100 of FIG. 3, and duplicate description is omitted.

To prevent vibration, the cabin 10 is elastically supported on the cabin support beam 13 provided on the bottom frame 12 of the upper turning body 3, via the damper 14. The receiver 30 extends upward from the bottom frame 12 of the upper turning body 3 and is placed between the cabin 10 and the first boom 4A (the first boom cylinder 7A on the left side). The receiver 30 includes a plate member 33 and one or more ribs 32 provided on the opposite side from the cabin 10 to extend laterally (horizontally) from the plate member 33. The plate member 33 is supported by the one or more ribs 32. The upper end of the receiver 30 is positioned higher than the top plate 4Aa of the first boom 4A. Furthermore, the receiver 30 is provided at a position corresponding to the front-side right vertical frame 11*a* of the cabin 10. That is, the receiver 30 is so placed as to overlap the front-side right vertical frame 11*a* as viewed from the side of the shovel 100.

A function of the receiver 30 is described below.

When the attachment is operated during the normal operation of the shovel 100, the second boom cylinder 7B pivots up and down on the bracket 4A1 provided on the top plate 4Aa of the first boom 4A serving as a support point. As illustrated in FIG. 5, the second boom cylinder 7B is pivotable without contacting the receiver 30.

For example, when the shovel 100 tips over counterclockwise to the side, the cabin 10 contacts the ground to receive the lateral force F on the upper part of the left side of the cabin 10 (see FIG. 5). In the case of receiving the lateral force F on the left side of the cabin 10, the cabin 10, which is elastically supported relative to the upper turning body 3, inclines toward the first boom 4A (rightward in FIG. 5), so that the front-side right vertical frame 11*a* of the cabin 10 contacts a contact part 31 of the receiver 30. As a result, the cabin 10 contacts the receiver 30 at the contact part 31 to be supported by the receiver 30. Furthermore, the receiver 30 is supported by the one or more ribs 32.

According to the shovel 100 of FIG. 5, when the cabin 10 deforms, the cabin 10 (the vertical frame 11*a*) starts to deform at a point contacting the contact part 31 of the receiver 30 because of the lateral force F. According to the shovel 100 of FIG. 5, the start point of deformation can be higher. Therefore, it is possible to control the deformation of the cabin 10.

Figure 6:
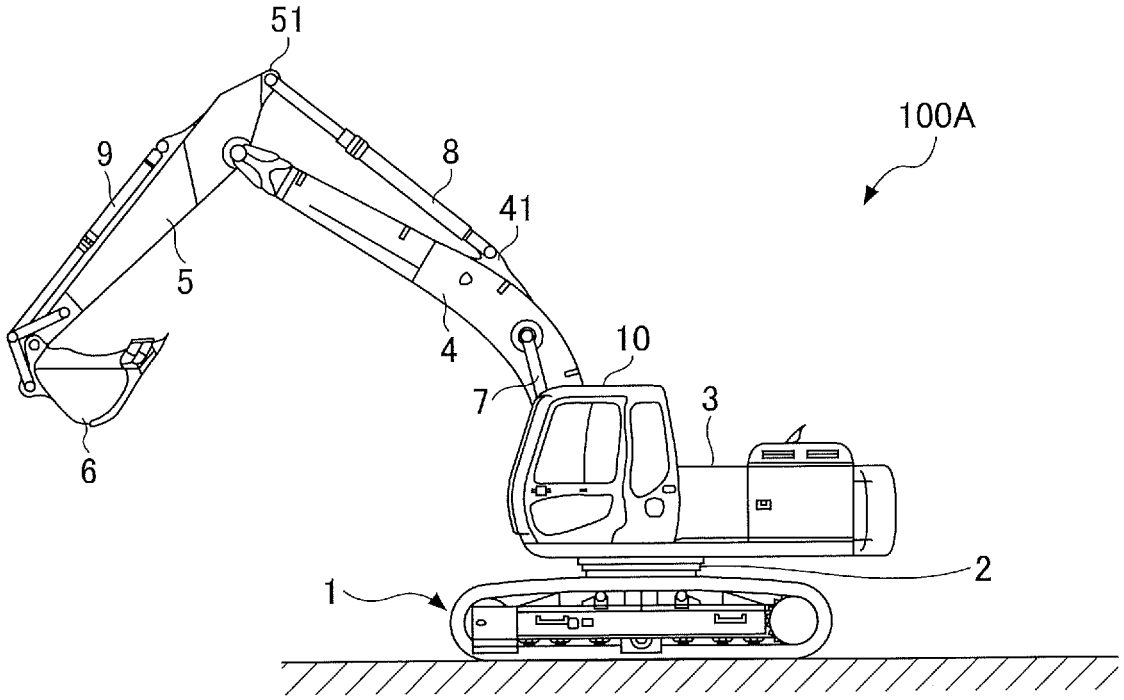
FIG. 6 is a side view of another shovel according to the embodiment.
Figure 7:
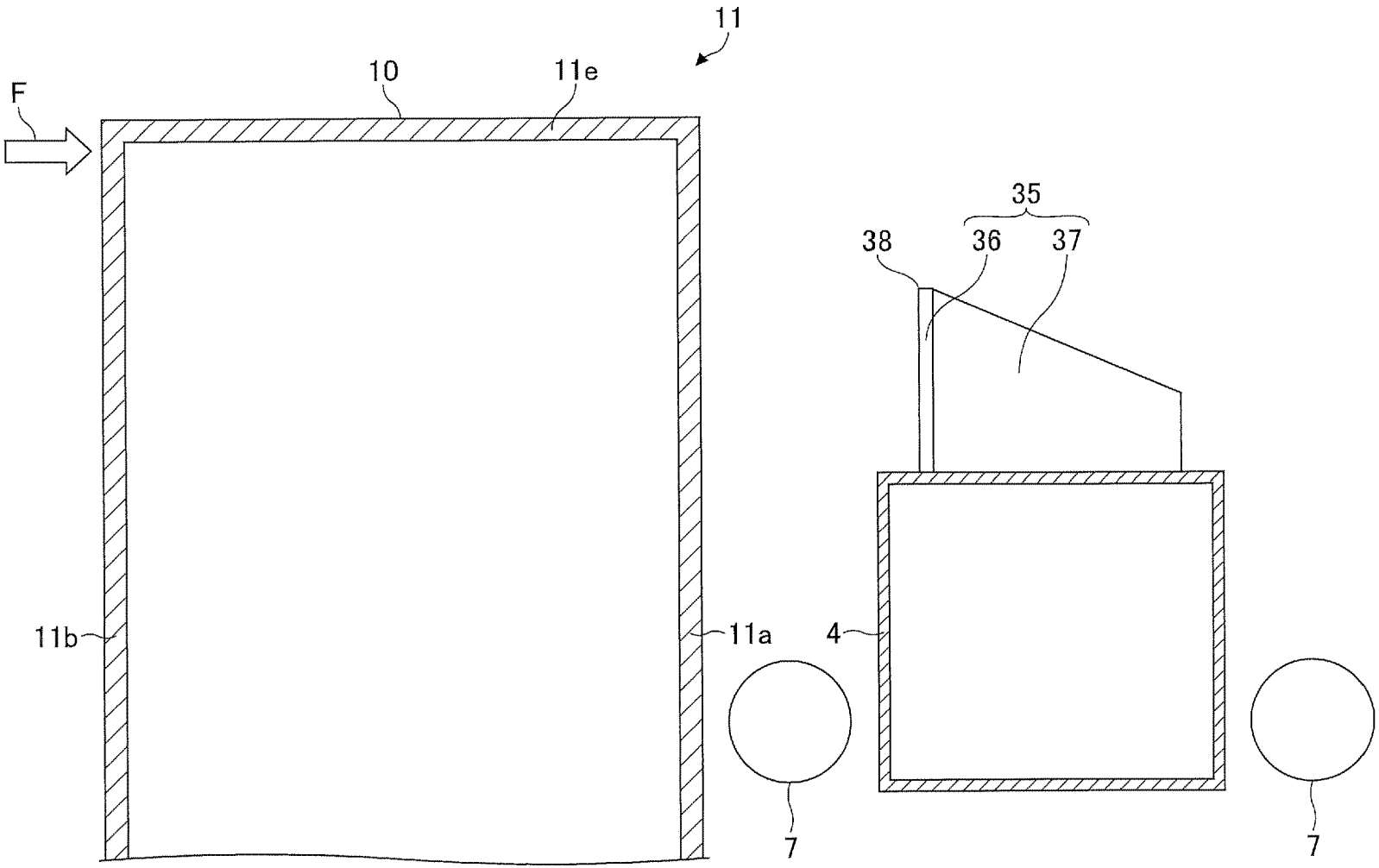
FIG. 7 is a sectional view of the shovel of FIG. 6.

An overview of another shovel 100A according to this embodiment is given with reference to FIGS. 6 and 7. FIG. 6 is a side view of the shovel 100A. FIG. 7 is a sectional view of the shovel 100A, corresponding to the sectional view of FIG. 3.

As illustrated in FIG. 1, the shovel 100 includes a two-piece boom including the first boom 4A and the second boom 4B as an attachment, while the shovel 100A is different from the shovel 100 in including a single boom 4 as an attachment as illustrated in FIG. 6. Furthermore, the shovel 100A is different from the shovel 100 in that a receiver 35 (a protection member) (see FIG. 7) is provided in place of the receiver 20 (see FIG. 3). Otherwise, the shovel 100A may be equal in configuration to the shovel 100, and duplicate description is omitted.

The shovel 100A includes the lower traveling body 1; the turning mechanism 2; the upper turning body 3 turnably mounted on the lower traveling body 1 via the turning mechanism 2; the boom 4, the arm 5, and the bucket 6 that constitute an attachment (a work machine); and the cabin 10.

The boom 4 is pivotally attached to the front center of the upper turning body 3 in such a manner as to be able to move up and down. The arm 5 is pivotally attached to the distal end of the boom 4 in such a manner as to be able to pivot up and down. The bucket 6 serving as an end attachment is pivotally attached to the distal end of the arm 5 in such a manner as to be able to pivot up and down. The boom 4, the arm 5, and the bucket 6 are hydraulically driven by boom cylinders 7, the arm cylinder 8, and the bucket cylinder 9 serving as hydraulic actuators, respectively.

As illustrated in FIG. 6, the boom cylinders 7 are provided as a pair, one on each side of the boom 4. The arrangement of the boom cylinders 7 is not limited to this. For example, a single boom cylinder may be provided below the boom 4. The arm cylinder 8 is provided above the boom 4. The arm cylinder 8 is, on its bottom side, rotatably attached to a bracket 41 centered on the top plate of the boom 4. That is, the bracket 41 is provided forward of (closer to the distal end of the boom 4 than) a position corresponding to the front-side right vertical frame 11*a* of the cabin 10. The arm cylinder 8 is, on its rod side, rotatably attached to a bracket 51 provided on the arm 5 at its proximal end.

The receiver 35 is provided on the top plate of the boom 4 at a position corresponding to the front-side right vertical frame 11*a* of the cabin 10. That is, the receiver 35 is so placed as to overlap the front-side right vertical frame 11*a* as viewed from the side of the shovel 100. The receiver 35 includes a plate member 36 and one or more ribs 37 extending laterally (horizontally) from the plate member 36.

A function of the receiver 35 is described below.

The receiver 35 is closer to the proximal end of the boom 4 than the bracket 41. This allows the arm cylinder 8 to pivot without contacting the receiver 35.

For example, when the shovel 100A tips over counterclockwise to the side, the cabin 10 contacts the ground to receive the lateral force F on the upper part of the left side of the cabin 10 (see FIG. 7). In the case of receiving the lateral force F on the left side of the cabin 10, the cabin 10, which is elastically supported relative to the upper turning body 3, inclines toward the boom 4 (rightward in FIG. 7), so that the front-side right vertical frame 11*a* of the cabin 10 contacts a contact part 38 of the receiver 35. As a result, the cabin 10 contacts the receiver 35 at the contact part 38 to be supported by the receiver 35.

According to the shovel 100A, when the cabin 10 deforms, the cabin 10 (the vertical frame 11*a*) starts to deform at a point contacting the contact part 38 of the receiver 35 because of the lateral force F. According to the shovel 100A, the start point of deformation can be higher. Therefore, it is possible to control the deformation of the cabin 10.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A shovel comprising:

a lower traveling body;

an upper turning body turnably mounted on the lower traveling body;

an attachment attached to the upper turning body;

a cabin mounted on the upper turning body; and a protection member configured to protect the cabin, the protection member being provided on the attachment or the upper turning body at a position corresponding to a front of the cabin, the protection member including a plate member including an opening open to the cabin, the opening being in a center of the plate member, and a plurality of ribs laterally extending from the plate member in a direction away from the cabin.

2. The shovel as claimed in claim 1, wherein the protection member is provided at a position corresponding to a front-side frame of the cabin.

3. The shovel as claimed in claim 1, wherein the attachment includes a first boom;

a second boom; and a boom cylinder placed above the first boom and configured to drive the second boom, and the plate member is provided on the first boom.

4. The shovel as claimed in claim 3, wherein the rib includes a circular arc part configured to contact the boom cylinder.

5. The shovel as claimed in claim 1, wherein the protection member overlaps the front of the cabin when viewed from a side of the shovel.

6. The shovel as claimed in claim 1, wherein the opening is provided in a part of the plate member in such a manner as to reduce stiffness of the part of the plate member against a force from a direction of the cabin.

7. The shovel as claimed in claim 1, wherein the cabin is seen through the opening from a side of the plate member on which side the plurality of ribs are provided on the plate member with the protection member being fixed to the attachment or the upper turning body.

8. A shovel comprising:

a lower traveling body;

an upper turning body turnably mounted on the lower traveling body;

an attachment attached to the upper turning body;

a cabin mounted on the upper turning body; and a protection member configured to protect the cabin, the protection member being provided on the attachment or the upper turning body at a position corresponding to a front of the cabin, wherein the attachment includes a first boom;

a second boom; and a boom cylinder placed above the first boom and configured to drive the second boom, the protection member includes a plate member provided on the first boom; and a rib, and the plate member includes a high stiffness part on which the rib is provided; and a low stiffness part lower in stiffness than the high stiffness part.

* * * * *